United States Patent [19]

Bilbrey

[11] Patent Number: 4,476,999

[45] Date of Patent: Oct. 16, 1984

[54] AUTOMATED LIQUID DISPENSER

[75] Inventor: Robert A. Bilbrey, Orinda, Calif.

[73] Assignee: American Hospital Supply Corporation, Evanston, Ill.

[21] Appl. No.: 570,277

[22] Filed: Jan. 12, 1984

Related U.S. Application Data

[63] Continuation of Ser. No. 297,955, Aug. 31, 1981, abandoned, which is a continuation-in-part of Ser. No. 285,516, Jul. 21, 1981, abandoned.

[51] Int. Cl.[3] ..... B67D 5/14

[52] U.S. Cl. ..... 222/75; 73/864.16

[58] Field of Search ..... 222/136, 52, 56, 63, 222/132, 309, 333, 144.5, 75; 251/178; 137/625.46; 73/864.16

[56] References Cited

U.S. PATENT DOCUMENTS 4,346,742 8/1982 Chase et al. ..... 73/864.16 X

*Primary Examiner*—Stanley H. Tollberg

*Attorney, Agent, or Firm*—James F. Mitchell

[57] ABSTRACT

An automated liquid dispenser for dispensing reagents or diluting samples with reagent automatically with enhanced accuracy, precision and speed, which comprises a dispenser frame carrying demountable precision metering syringes that are reciprocated and a rotary valve for each syringe that is stepped in accord with a programmed local microprocessor or remote computer control to connect the syringe selectively in sequence to one of a sample probe, reagent reservoir, atmosphere or another syringe cylinder.

7 Claims, 17 Drawing Figures

AUTOMATED LIQUID DISPENSER

This application is a continuation of application Ser. No. 297,955 filed Aug. 31, 1981, abandoned, which in turn is a continuation-in-part of Ser. No. 285,516 filed July 21, 1981, abandoned.

This invention relates generally to automated liquid dispensers and more particularly to a bench-top laboratory instrument which employs one or more easily demountable precision metering syringes reciprocated in response to a programmed microprocessor or computer control for selectively dispensing reagent or diluting samples with reagent and other common normally manual laboratory procedures.

One object of the invention is to provide a precision laboratory instrument for automating many common normally manual liquid handling laboratory procedures with improved accuracy, precision, speed and reproducibility.

Another object of the invention is to provide a liquid dispensing apparatus capable of local microprocessor or remote computer control.

Another object of the invention is to provide a quick-release syringe chucking arrangement whereby precision metering syringes of different sizes can be quickly and simply interchanged in the instrument.

Other objects and advantages of the invention will become apparent upon consideration of the following written description and the accompanying drawings wherein.

Figure 1:
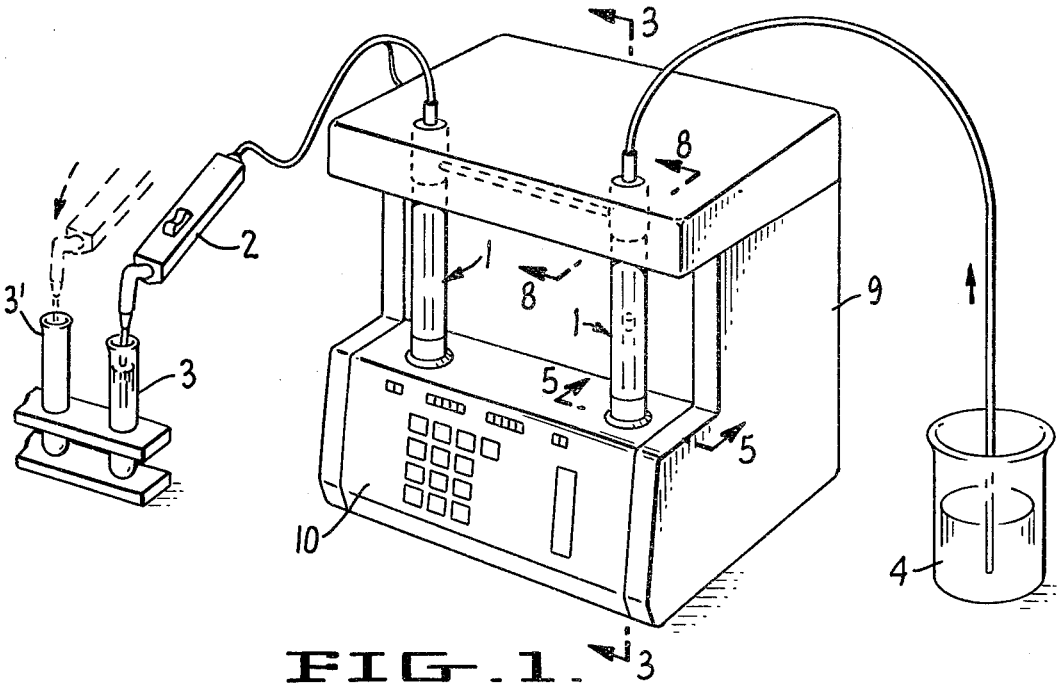
FIG. 1 is an overall perspective view of the liquid dispenser with dual syringes.

The instrument illustrated in FIG. 1 is designed for actuation of two precision metering syringes. The invention also is useful in the form of a single syringe shown in FIG. 17 or more than two syringes with appropriate valving and actuator changes which will be apparent from a consideration of the following description.

Figure 17:
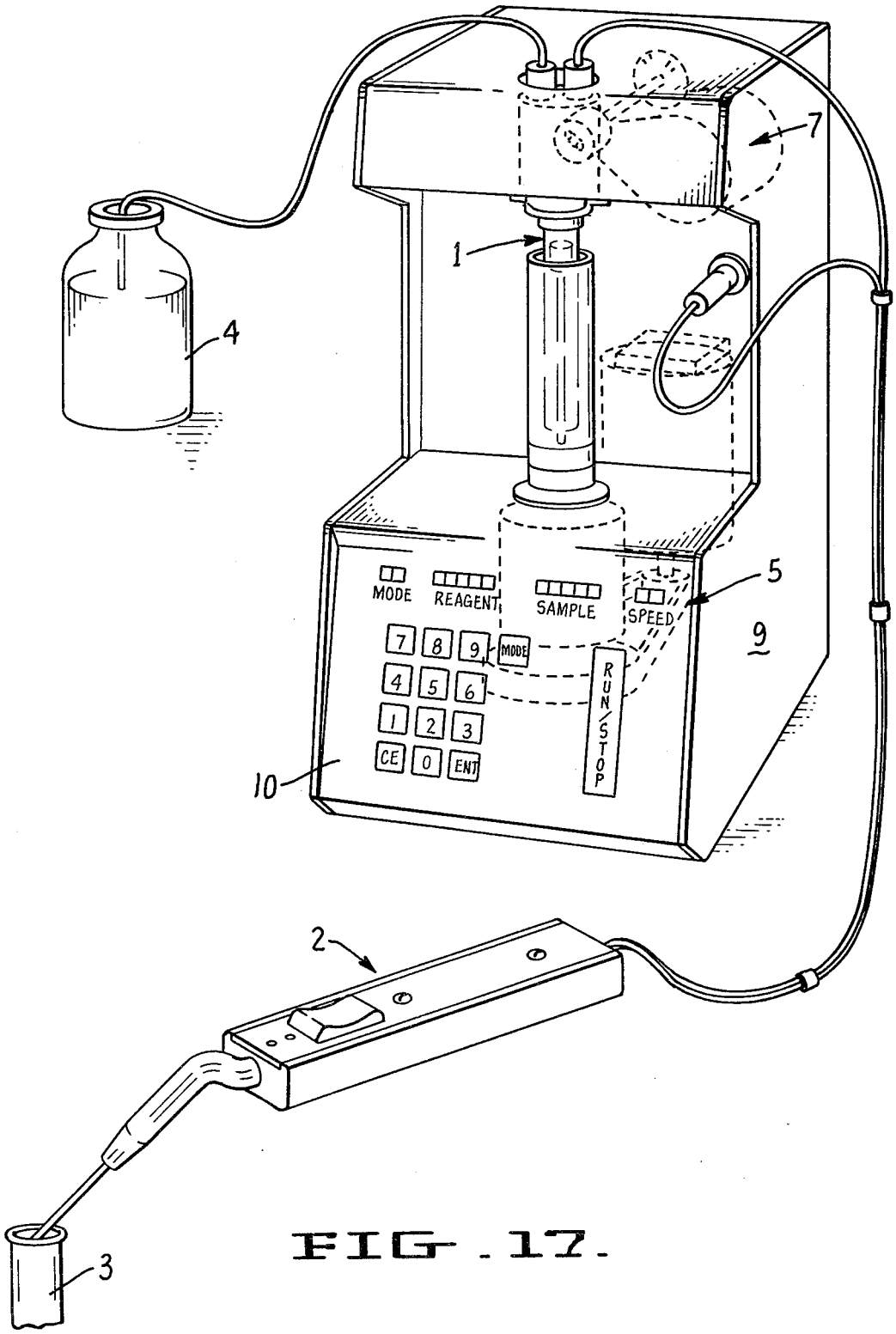
FIG. 17 is an overal perspective view of the liquid dispenser with a single syringe.

The illustrated instrument includes one or more precision metering syringes 1 arranged for drawing sample by means of probe 2 from a test tube 3, for example, or for dispensing sample or reagent-diluted sample into test tube 3', shown in hidden lines in FIGS. 1 and 17. The instrument is capable of withdrawing reagent from a reservoir, such as from beaker 4, and then using it to dilute a sample or otherwise to be dispensed from the probe 2.

Figure 2:
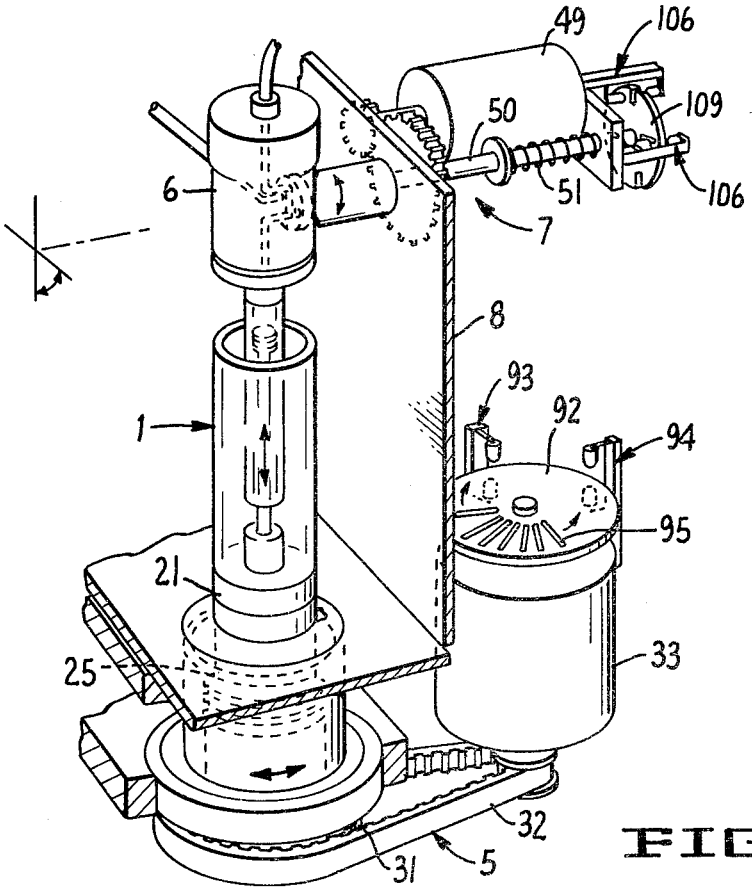
FIG. 2 is a partial perspective view illustrating a typical metering syringe and the actuator and valve means for it.
Figure 3:
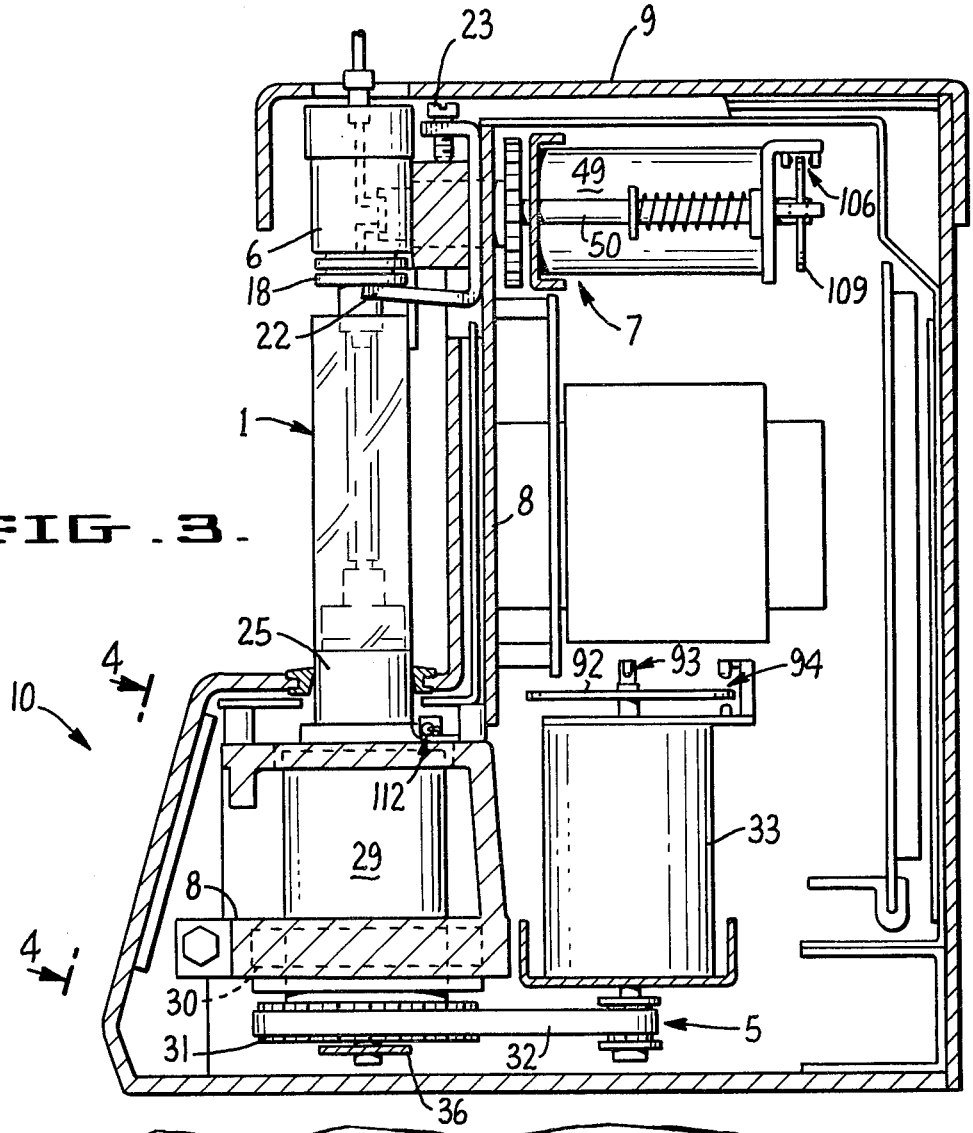
FIG. 3 is a vertical cross-sectional view of the instrument taken along line 3—3 of FIG. 1.
Figure 4:
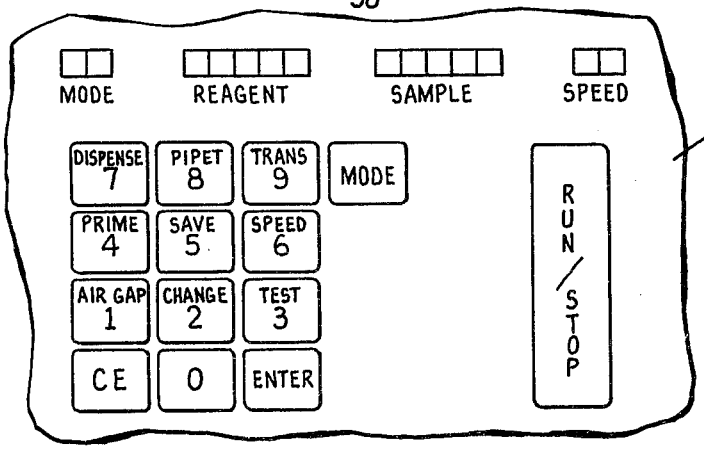
FIG. 4 is a plan view of one form of keyboard for the instrument taken along line 4—4 of FIG. 3.
Figure 6:
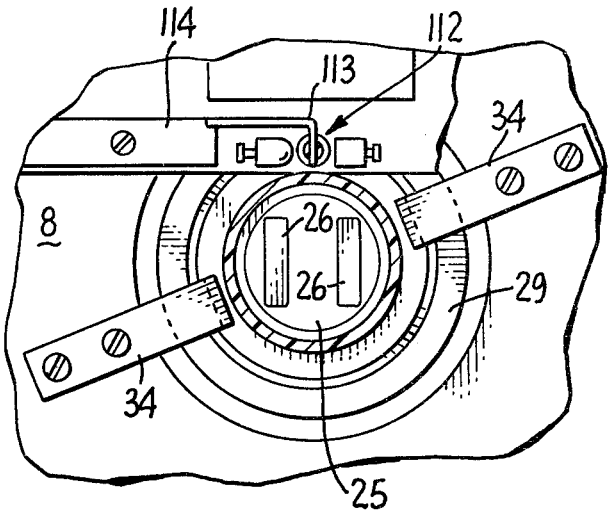
FIG. 6 is a top view of the lead-screw nut and its clamping arrangement taken along line 6—6 of FIG. 5.

Each metering syringe 1 mounts upon a syringe actuator, referred to generally as 5, in FIG. 2 at its rod end and is in fluid-tight communication with valve means 6 in FIG. 2. The syringe actuator 5, valve means 6 and its valve actuator, referred to generally as 7, mount upon a rigid frame 8. A housing 9 of chemical resistent material encloses the working components of the instrument apart from the metering syringes which are open for observation and ease of removal and replacement. A keyboard 10 for local microprocessor control mounts on the housing 9 on the front of the instrument adjacent to the metering syringes.

Figure 14:
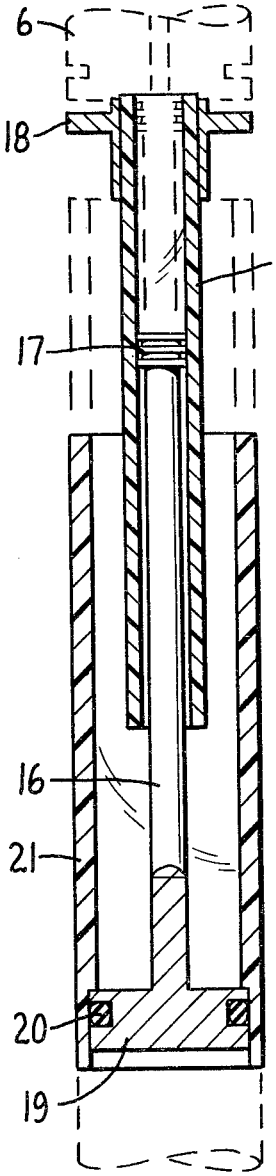
FIG. 14 is a vertical sectional view of a small bore syringe used in the instrument.
Figure 15:
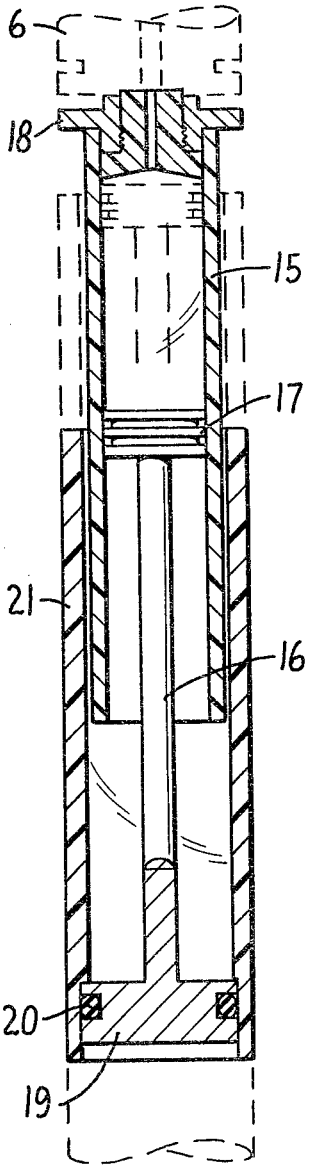
FIG. 15 is a vertical sectional view of a large bore syringe used in the instrument.
Figure 16:
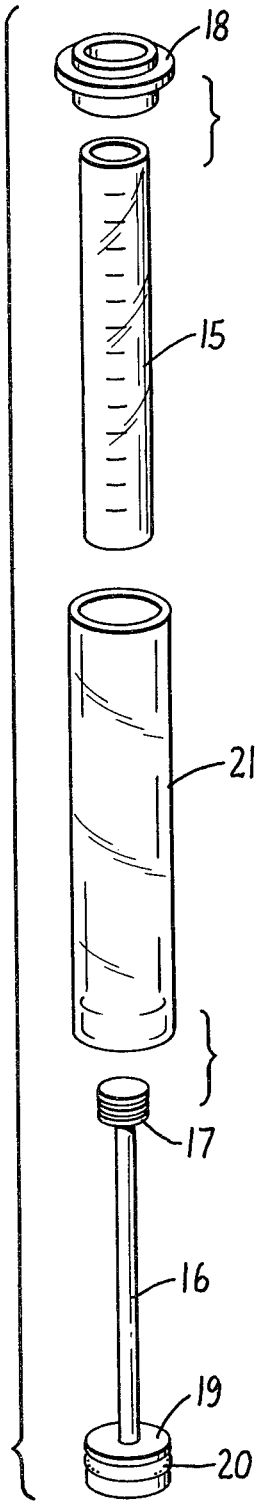
FIG. 16 is an exploded view of the metering syringe components.

Each metering syringe, as is more particularly shown in FIGS. 14–16, comprises a precision ground glass cylinder 15 and a piston 16 carried on a piston rod 17 reciprocable within the cylinder. A connecting flange and seat 18 seals upon the blind end of the cylinder. The seat fits within a recess in the valve means 6 that mounts upon the frame 8. The connecting flange 18 is clamped to the valve means 6 by clamp 22 and set-screw 23.

The end of the piston rod 17 remote from piston 16 carries a mounting flange 19 made from magnetic material. In the particular embodiment illustrated, the mounting flange 19 carries on its periphery an o-ring 20 with which to secure to the flange a centering sleeve 21. The centering sleeve, as is more particularly illustrated in FIG. 7, centers the mounting flange 19 upon the end of an externally threaded lead-screw nut 25 over which the sleeve fits. The nut 25 carries permanent magnet 26 which holds the flange 19 of magnetic material firmly to the top of the lead-screw nut centered thereon by sleeve 21. The sleeve 21 sealed by o-ring 20 to mounting flange 19 also functions as an open reservoir to contain leaks or provide spill protection should a fragile glass syringe break or fracture.

The external thread 27 on the lead-screw nut 25 threads upon corresponding threads 28 formed on the internal surface of lead-screw sleeve 29 which is rotatably mounted in ball bearings 30 upon frame 8. The sleeve 29 is rotated by a toothed belt gear 31 and drive belt 32 by servo motor drive means 33 shown in FIG. 2.

Figure 7:
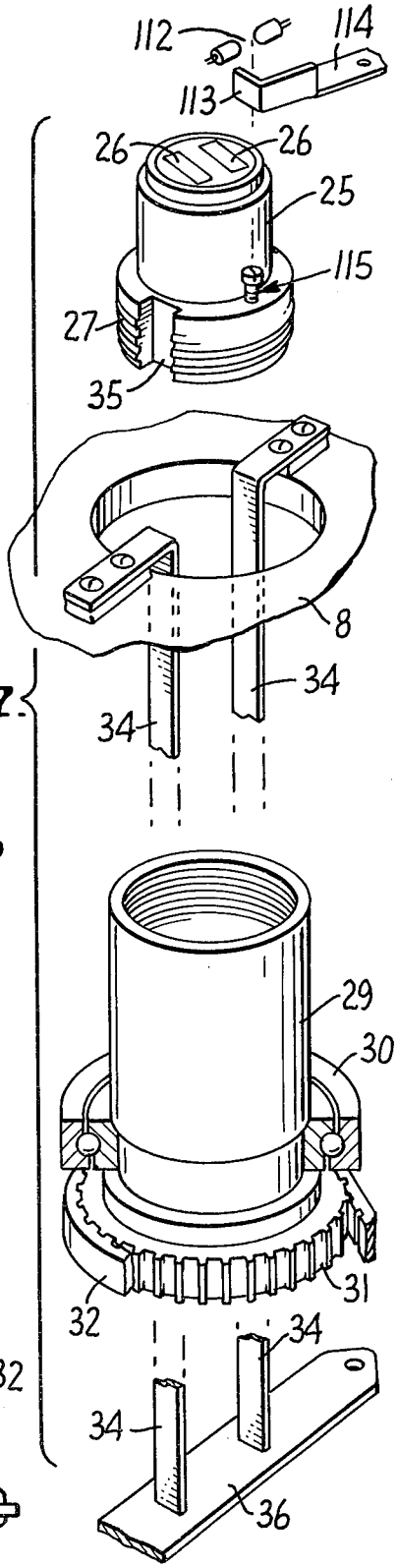
FIG. 7 is an exploded view of the internal lead-screw drive for each syringe actuator.
Figure 5:
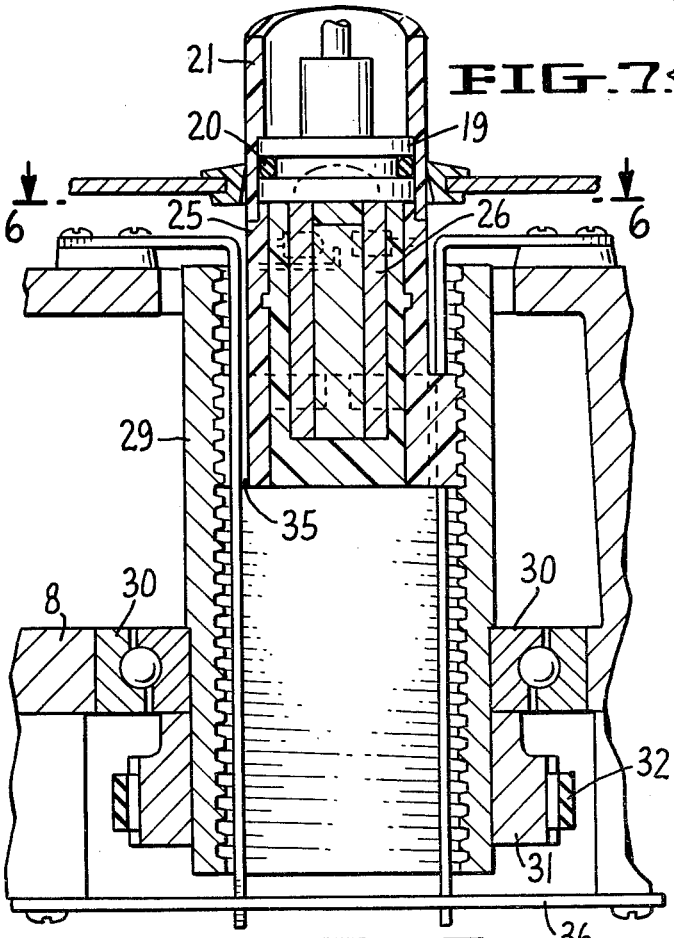
FIG. 5 is a vertical sectional view of the lead-screw drive for one syringe actuator taken along line 5—5 of FIG. 1.
Figure 9:
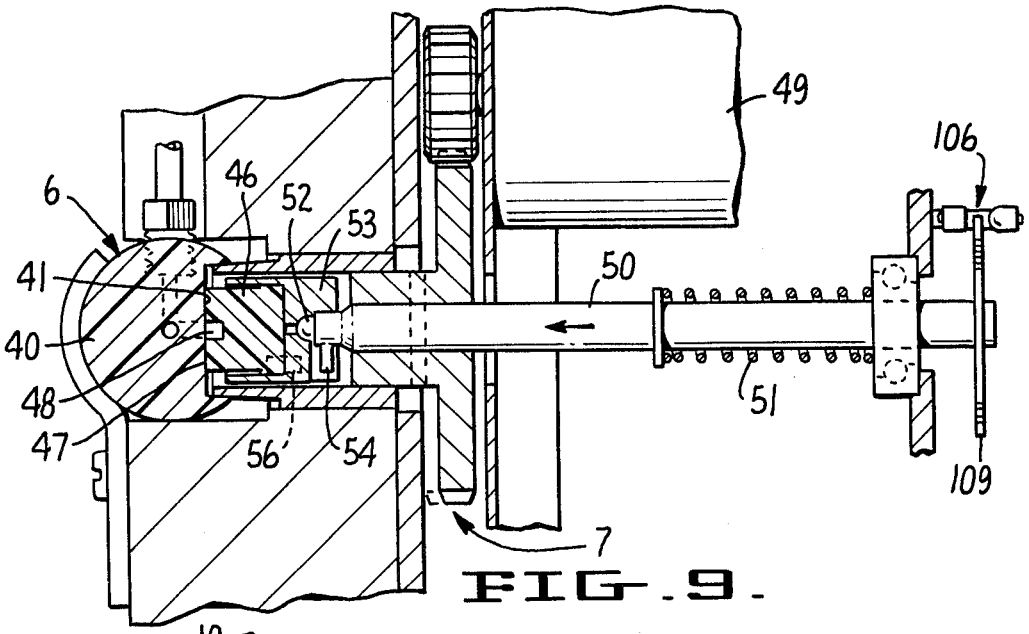
FIG. 9 is a plan view partly in section of the valve means and valve actuator taken along line 9—9 of FIG. 8.
Figure 8:
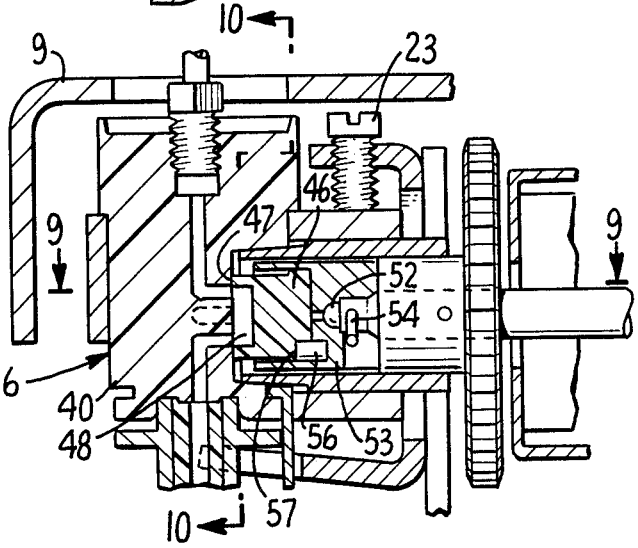
FIG. 8 is a vertical sectional view of the valve means for each syringe taken along line 8—8 of FIG. 1.

The lead-screw nut 25 is restrained from rotation relative to this sleeve 29 by the pair of brackets 34 mounted at one end upon the frame 8 as shown in FIG. 7 and passing through slots 35 formed in the lead-screw nut 25. The brackets are secured at the bottom ends also to the frame 8 by means of a slotted plate 36 which fits over the free end of each bracket and is screwed to the frame as is illustrated in FIG. 5.

Figure 10:
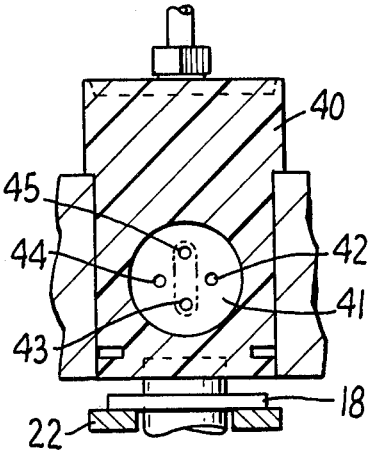
FIG. 10 is a vertical, partially sectional view of the valve means taken along line 10—10 of FIG. 8.
Figure 11:
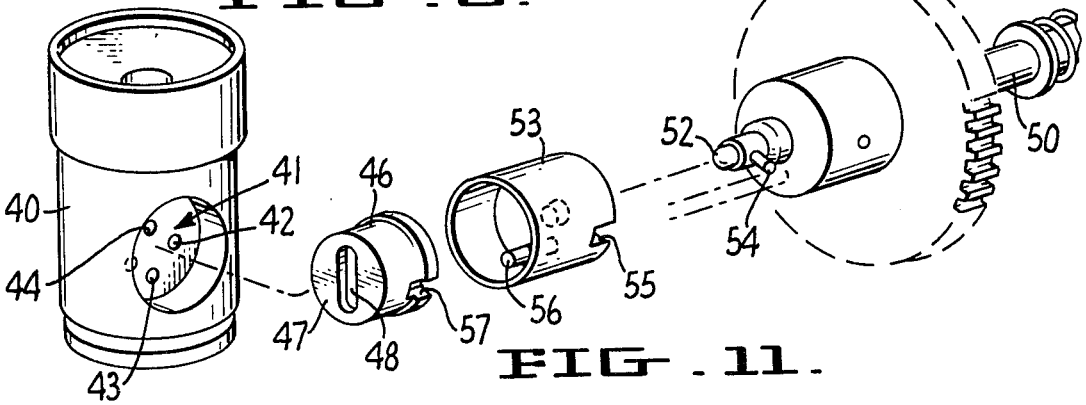
FIG. 11 is an exploded view of the valve means and valve actuator for each metering syringe.
Figure 12:
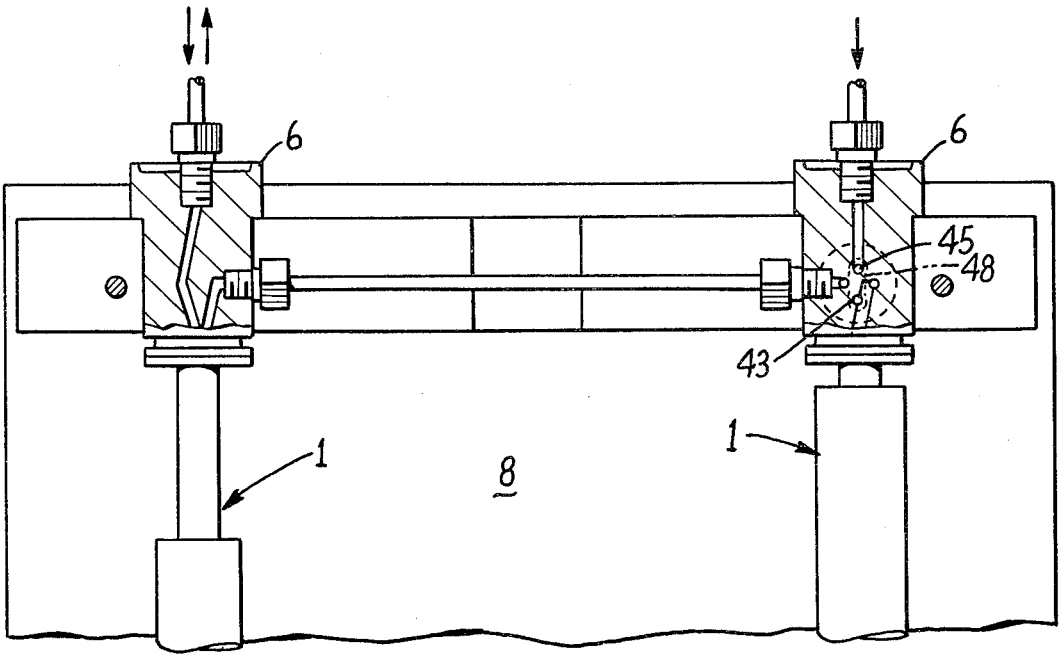
FIG. 12 illustrates the valving configuration for a dispenser with two syringes as shown in FIG. 1.
Figure 13:
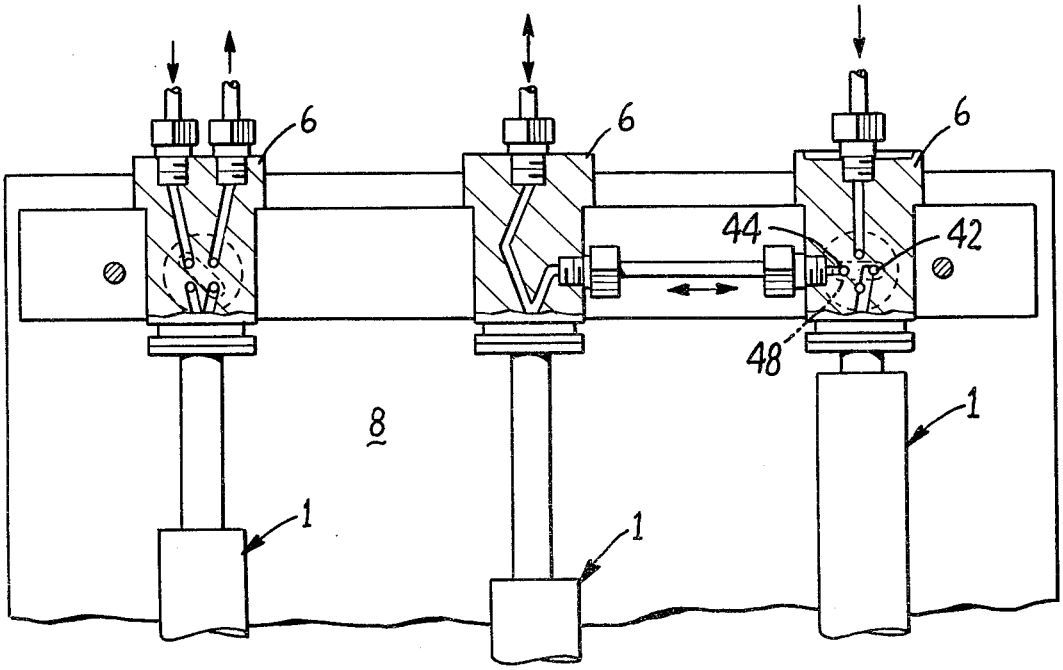
FIG. 13 illustrates the valving arrangement for a dispenser with three syringes for example.

The valve means 6 mounted in fluid communication with the blind end of each metering syringe is more particularly shown in FIGS. 8–11. Each includes a valve body 40 having a generally planar valve seat 41 bored with four ports 42, 43, 44 and 45 as illustrated in FIG. 10. The illustrated ports are in diametrically opposed pairs and each is equidistant from the rotational axis of a mating rotor 46. The spring-loaded rotor 46 has a replaceable seating face 47 having a fluid communication groove 48 on its valving face which communicates pairs of the ports 42–45 with one another in a programmed selection sequence by valve actuator means 7. The valve actuator may be a gearhead motor or include a drive motor 49 geared to a drive shaft 50 that is biased by spring 51, ball 52 and sleeve 53 against the rotor 46 to hold the rotor in fluid-tight seating relationship with the valve seat 41. The pin 54 carried on drive shaft 50 mates with a recess 55 in the sleeve 53 and pin 56 on the sleeve mates with recess 57 in rotor 46 to enable the actuator means 7 to rotate the groove 48 into selected communication among the valve ports 42–45.

Operation of the dispenser is automated by a local microprocessor control using keyboard 10 and described more particularly in co-pending application Ser. No. 297,956. The dispenser operation also can be controlled by a programmed remote computer. In either case the microprocessor controls the stroke and speed and senses the instantaneous position of each piston in the metering syringes in a manner there described so that those parameters can be varied upon command inputed through the keyboard 10 or remote computer interface.

Various modes of operation may be selected and preprogrammed into the microprocessor including the basic liquid transfers of drawing fluid into each syringe from the reagent reservoir, dispensing fluid from the syringe into the reagent reservoir, drawing fluid into the syringe from the sample probe tube or dispensing fluid from the syringe into the sample probe. Various modes of operation are obtainable including a dispense mode wherein a measured volume of liquid is drawn into a syringe from the reagent reservoir and then dispensed into the sample probe. In a pipette/dilute mode a measured volume of liquid is drawn from the reagent reservoir and then one or more separate samples are aspirated into the sample probe with air gaps separating one sample from another and from the reagent. Then the total content of the syringe may be dispensed back out through the sample probe. Various wash, purge and other modes can also be programmed into the microprocessor.

The hand held probe may carry electrical switches for actuating the delivery and aspiration cycles by energizing the valve actuator 7. The probe also may include indicating means showing the instanteous position in the sequential mode of operation. The probe handle clamps to chemically inert tubing communicating it with the valve means 6 for one or several of the metering syringes. The tubing is bundled with electric conductors connecting the probe switches, microprocessor and valve actuating means.

Various modifications of the described dispenser will become apparent to those skilled in the art within the scope of the invention that is defined in the following claims.

I claim:

1. An automated liquid dispenser comprising:

a frame;

at least one demountable precision metering syringe mounted on the frame;

a motor driven syringe actuator for each metering syringe;

valve means for selectively connecting the cylinder of each metering syringe to one of a sample probe, reagent reservoir, atmosphere or another syringe cylinder;

a valve actuator for selecting the position for each valve;

a sample probe carrying electrical switch means for controlling the valve actuator; and a microprocessor controlled for the syringe and valve actuator programmed in response to a preselected sequence of operating commands.

2. In an automated liquid dispenser having, a frame, at least one precision metering syringe with a precision bored cylinder and a piston carried on a piston rod reciprocable within the cylinder, valve means for selectively connecting the syringe cylinder to one or more of a set of intake and delivery valve ports and a motor driven syringe actuator on the frame for reciprocating the syringe, an improved quick-release chucking arrangement comprising:

a first mounting means on the blind end of the cylinder;

clamp means for mechanically clamping the first mounting means and cylinder to the valve means in fluid-tight communication;

a second magnetic mounting means on the piston rod external to the cylinder; and permanent magnet means on the syringe actuator for holding the magnetic mounting means securely to the actuator.

3. The quick-release chucking arrangement of claim 2 wherein the magnetic mounting means is a flange having the same diameter as the syringe actuator abuting it and further comprising a centering tube sleeved over the flange and the abutting portion of the syringe actuator.

4. The automated liquid dispenser of claim 2 wherein the syringe actuator comprises an internally threaded lead-screw sleeve rotatably mounted on the dispenser frame;

drive means for rotating the lead-screw sleeve;

an externally threaded lead-screw nut within the sleeve for seating the rod end of the syringe; and clamp means on the frame restraining the lead-screw nut from rotation with respect to the sleeve.

5. The automated liquid dispenser of claim 1 wherein the valve means comprises a valve body having a valve seat and ports passing through the surface of the valve seat each for communication with a separate fluid conduit;

a valve rotor having a seating face shaped in conformance with the valve seat and seated in fluid-tight contact with the valve seat;

a fluid communication groove formed in the seating face of the rotor to communicate selectively a pair of valve ports with one another;

and spring bias means pressing the seating face of the rotor into fluid-tight contact with the valve seat.

6. The dispenser of claim 5 further comprising valve actuator means for stepping the rotor from one set of port communication positions to another.

7. The dispenser of claim 5 wherein the ports are arranged in diametrically opposed pairs and each port is equidistant from the rotational axis of the rotor.

* * * * *